US008876138B2

(12) United States Patent
Wilde

(10) Patent No.: US 8,876,138 B2
(45) Date of Patent: Nov. 4, 2014

(54) HEIGHT ADJUSTABLE WHEELCHAIR SEAT

(71) Applicant: Francis Wilde, Port Jefferson Station, NY (US)

(72) Inventor: Francis Wilde, Port Jefferson Station, NY (US)

( * ) Notice: Subject to any disclaimer, the term of this patent is extended or adjusted under 35 U.S.C. 154(b) by 0 days.

(21) Appl. No.: 14/067,407

(22) Filed: Oct. 30, 2013

(65) Prior Publication Data

US 2014/0167388 A1 Jun. 19, 2014

Related U.S. Application Data

(60) Provisional application No. 61/736,592, filed on Dec. 13, 2012.

(51) Int. Cl.
*A61G 5/10* (2006.01)
*A61G 5/14* (2006.01)

(52) U.S. Cl.
CPC ..... *A61G 5/1043* (2013.01); *A61G 2005/1045* (2013.01); *A61G 5/14* (2013.01)
USPC ..... 280/304.1; 280/250.1; 297/313

(58) Field of Classification Search
CPC ..... A61G 5/10; A61G 2005/10; A61G 2005/1043; A61G 2005/1045; A61G 2005/1054; A61G 2005/1091
USPC ..... 280/250.1, 304.1, 647, 650; 297/183.6, 297/183.9, 313, 331, 335, DIG. 10
See application file for complete search history.

(56) References Cited

U.S. PATENT DOCUMENTS 2,400,155 A * 5/1946 Letschert et al. ..... 5/626
3,259,427 A * 7/1966 Wiest ..... 297/183.9
3,712,666 A * 1/1973 Stoll ..... 297/61
4,574,901 A * 3/1986 Joyner ..... 180/65.1
4,637,654 A * 1/1987 Boardman ..... 297/337
4,671,570 A * 6/1987 Hockenberry et al. ..... 297/337
4,690,457 A * 9/1987 Poncy et al. ..... 297/337
4,929,022 A * 5/1990 Geraci ..... 297/313
4,955,624 A 9/1990 Jeun-Long
4,979,726 A * 12/1990 Geraci ..... 297/313
5,413,367 A * 5/1995 Ochiai ..... 280/250.1
5,437,497 A 8/1995 Hutson
6,193,313 B1 * 2/2001 Jonsson ..... 297/284.1
6,371,503 B2 * 4/2002 Ritchie et al. ..... 280/304.1
6,431,650 B1 8/2002 Visone
6,439,665 B1 * 8/2002 Cvek ..... 297/440.11
6,454,285 B1 * 9/2002 Koenig ..... 280/250.1
6,467,785 B2 10/2002 Toppses
6,739,610 B2 * 5/2004 Connors et al. ..... 280/304.1

(Continued)

*Primary Examiner* — Anne Marie Boehler
*Assistant Examiner* — Maurice Williams
(74) *Attorney, Agent, or Firm* — Daniel Boudwin; Global Intellectual Property Agency LLC

(57) ABSTRACT

The present invention provides a wheelchair device configured to reduce the likelihood that a user might fall out of a wheelchair. The device includes a wheelchair frame, a lever, and a seat cushion, whereby the seat cushion is flexible and configured to sink into a recessed and angled orientation when occupied by a user. The sunken seat cushion serves to encourage a user to attain proper posture and further serves to reduce the chances that a user might fall forward out of the seat. The lever of the present invention is attached to the underside of the wheelchair device and comprises a handle portion and a flat base portion with a curved upper surface. A forward actuation of the handle results in the lever rotating about the wheelchair, causing the base to contact and lift the seat cushion to a level that facilitates the exiting of the wheelchair device.

1 Claim, 4 Drawing Sheets

(56) References Cited

U.S. PATENT DOCUMENTS

| | | | | |
|---|---|---|---|---|
| 6,851,751 | B1 * | 2/2005 | Romero et al. | 297/331 |
| 6,863,293 | B2 * | 3/2005 | Kimura et al. | 280/304.1 |
| 7,806,478 | B1 * | 10/2010 | Cvek | 297/300.1 |
| 7,845,665 | B2 * | 12/2010 | Borisoff | 280/250.1 |
| 8,113,587 | B1 * | 2/2012 | Zarinfar et al. | 297/337 |
| 8,177,302 | B2 * | 5/2012 | Carlson et al. | 297/452.64 |
| 8,360,518 | B2 * | 1/2013 | Braaten | 297/183.6 |
| 2002/0175027 | A1 * | 11/2002 | Usherovich | 188/2 F |
| 2003/0011229 | A1 | 1/2003 | Bell | |
| 2004/0212177 | A1 * | 10/2004 | Kuiken | 280/647 |
| 2005/0179293 | A1 * | 8/2005 | Wilcox | 297/313 |
| 2008/0067849 | A1 * | 3/2008 | Frencken | 297/330 |
| 2010/0148466 | A1 * | 6/2010 | Richter et al. | 280/250.1 |
| 2010/0207434 | A1 * | 8/2010 | Kurrasch et al. | 297/217.2 |
| 2010/0244523 | A1 * | 9/2010 | Ho | 297/338 |
| 2012/0074668 | A1 * | 3/2012 | Braaten | 280/304.1 |
| 2013/0187356 | A1 * | 7/2013 | Hazeleger | 280/250.1 |

* cited by examiner

HEIGHT ADJUSTABLE WHEELCHAIR SEAT

CROSS REFERENCE TO RELATED APPLICATION

This application claims the benefit of U.S. Provisional Application No. 61/736,592 filed on Dec. 13, 2012, entitled "Safe Wheel Chair." The above identified patent application is herein incorporated by reference in its entirety to provide continuity of disclosure.

BACKGROUND OF THE INVENTION

1. Field of the Invention

The present invention relates to a wheelchair. More specifically the present invention relates to a wheelchair seat that prevents occupants from falling therefrom by providing a recessed and angled sitting area.

Wheelchairs are used as a walking replacement for those who are unable to walk or for those that find walking for an extended period of time to be a difficult task. A wheelchair provides a solution for those who are unable to walk, however, prolonged use of a wheelchair may become uncomfortable. The seat may comprise poor padding, may be stiff, or may orient the back in non-ergonomic positions. Moreover, the user may not be strong enough to lift themselves to exit the wheelchair without pain.

Users have designed wheelchairs with height adjustment mechanisms installed on the sitting area to solve the setbacks of traditional wheelchairs. These height adjusters are designed to keep a person within a wheelchair seat, and thereafter raise the seat when the user wishes to exit the wheelchair. A user may sit within a traditional wheelchair seat and actuate a lever or button that facilitates the raising or lowering of the seat.

While this solution might temporary alleviate the issue, a new problem arises in that the user is now too high on the wheelchair, which increases the chances that a person might fall forward and out of the wheelchair. Additionally, the height adjustment mechanisms often require the purchasing of a new wheelchair. These height adjustment mechanisms merely lift the user upward, and does not orient them in a position to easily exit the wheelchair. Additionally, these prior art devices may orient a user in a position that increases their chances of falling out of the wheelchair.

The present invention relates to a wheelchair including a height adjustable seating area, whereby the seating area reduces the likelihood that a user would fall from out of the chair. The device comprises a wheelchair that includes a recessed and angled sitting area. This functions to lower the center of gravity of the user, which prevents one from falling out of the chair; whereas systems that lack a recessed seating area are prone allowing falls. The device further includes a lever that is manually actuated to raise or lower the height of the sitting area for ease of entry or exit of the seating area.

2. Description of the Prior Art

Devices have been disclosed in the prior art that relate to wheelchairs. These include devices that have been patented and published in patent application publications. These devices generally relate to wheelchairs including height adjustable seats. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 4,955,624 to Jeun-Long teaches a wheelchair with a height-adjustable seat. The chair includes a telescoping cross members mounted behind the back of the wheelchair and four vertical guide rods with two horizontal supporting members to support the seat of the wheelchair that permit the eat to be height adjustable. The device of Jeun-Long includes a height adjustable chair, however the chair fails to provide a recessed area that is angled to reduce the chances that an occupant would fall from the chair.

U.S. Pat. No. 5,437,497 to Hutson discloses a wheelchair including a height adjustable seat, wherein the wheelchair includes a substantially flat seat and a plurality of belt means adapted to support the seat. The wheelchair further includes a pair of horizontally spaced seat support bars that are supported in position by a pair of cross-bars. A plurality of hooks are adapted to be slidably received on the belt means and are adapted to releasably engage the seat support bars and support the seat in the desired vertical position. However, while the wheelchair of Hutson includes a height adjustable wheelchair seat, the seat fails to provide a sitting area that is adapted to reduce the odds that an occupant might fall from the chair.

Another device is U.S. Pat. No. 6,431,650 to Visone. Visone describes a height adjustable wheelchair that enables a user to move easily into and out of the wheelchair. The wheelchair includes a wheel assembly upon which a frame is mounted. A seat member is mounted to the frame and is adapted to be raised and lowered by a frame-mounted lift assembly. Although the wheelchair device of Visone includes an adjustable component, it fails to offer an angled and recessed siting area that reduces the chances that an occupant might fall out of the sitting section of the wheelchair.

U.S. Pat. No. 6,467,785 to Toppses teaches an adjustable seat wheelchair, wherein the seat can be raised and lowered between a normal height and the ground level for enabling a person to gain access to the seat from a ground level. Additionally, the seat can be raised to above normal levels for assisting a user in reaching higher placed objects. While Toppses discloses a wheelchair that is capable of raising and lowering a user, it differs from the present invention in that it fails to provide a mechanism that encourages a posture that reduces the chances of a user falling off of the wheelchair.

Finally, U.S. Patent Publication No. 2003/0011229 to Bell teaches a wheelchair having a height adjustable seat. The wheelchair seat and back are connected together, and include a base with a connector for connecting the base to the frame of the wheelchair. An elevator is operably connected to the base and the seat for adjusting the height of the seat. The adjustable wheelchair seat of Bell, although similar in nature and relevant to the present invention, fails to teach a recessed and angled seat that encourages a posture that reduces the chances that a user would fall out of the wheelchair.

The present invention relates to a novel wheelchair having a height adjustable sitting area that increases comfort and reduces the likelihood that a person might fall from out of the chair. The device accomplishes this task by having a sitting area that is both recessed and angled, which prevents one from falling out of the chair. The wheelchair device comprises a wheelchair frame, a mesh cushion, and a lever; whereby the lever comprises a flat base with a curved upper portion and a handle section. In use, the lever is manually actuated to raise or lower the height of the sitting area for ease of entry or exit of the seating area. When the handle is actuated forward, the base comes into contact with the seat cushion and raises the seat to the desired exiting level.

In view of the drawbacks of the prior art devices, it is shown that the prior art has several known setbacks and that the present invention is substantially divergent in design elements from the prior art and subsequently it is clear that there is a need in the art for an improvement to existing height adjustable wheelchairs. In this regard the instant invention substantially fulfills these needs.

SUMMARY OF THE INVENTION

In view of the foregoing disadvantages inherent in the known types of wheelchairs now present in the prior art, the present invention provides a new device wherein the same can be utilized for providing convenience for the user when a height adjustable seat is desired while also offering a comfortable seat that encourages a posture that reduces the chances of falling out of the chair.

The present invention is designed for those who desire the use of a wheelchair that includes a supportive seat, but one that is soft enough to allow a user to sink down so that the user's knees are slightly elevated above the waistline, whereby the user's posterior is at a lower point than the rest of the body. Such a device enables individuals to remain comfortable while also increasing the stability of the user's posture.

It is therefore an object of the present invention to provide a new and improved wheelchair device that has all of the advantages of the prior art and none of the disadvantages.

It is another object of the present invention to provide a new and improved wheelchair comprising a means for adjusting the height of the seat, whereby the seat is adjustable between a recessed position and a position level with the frame of the wheelchair device.

Another object of the present invention is to provide a wheelchair having a recessed and angled seating area, whereby the seating area is reduces the chances that a user falls out of the chair by reducing their center of gravity on the chair.

A final object of the present invention is to provide a mesh seat cushion, whereby the seat cushion can be retrofitted into an existing wheelchair or built into a new one.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
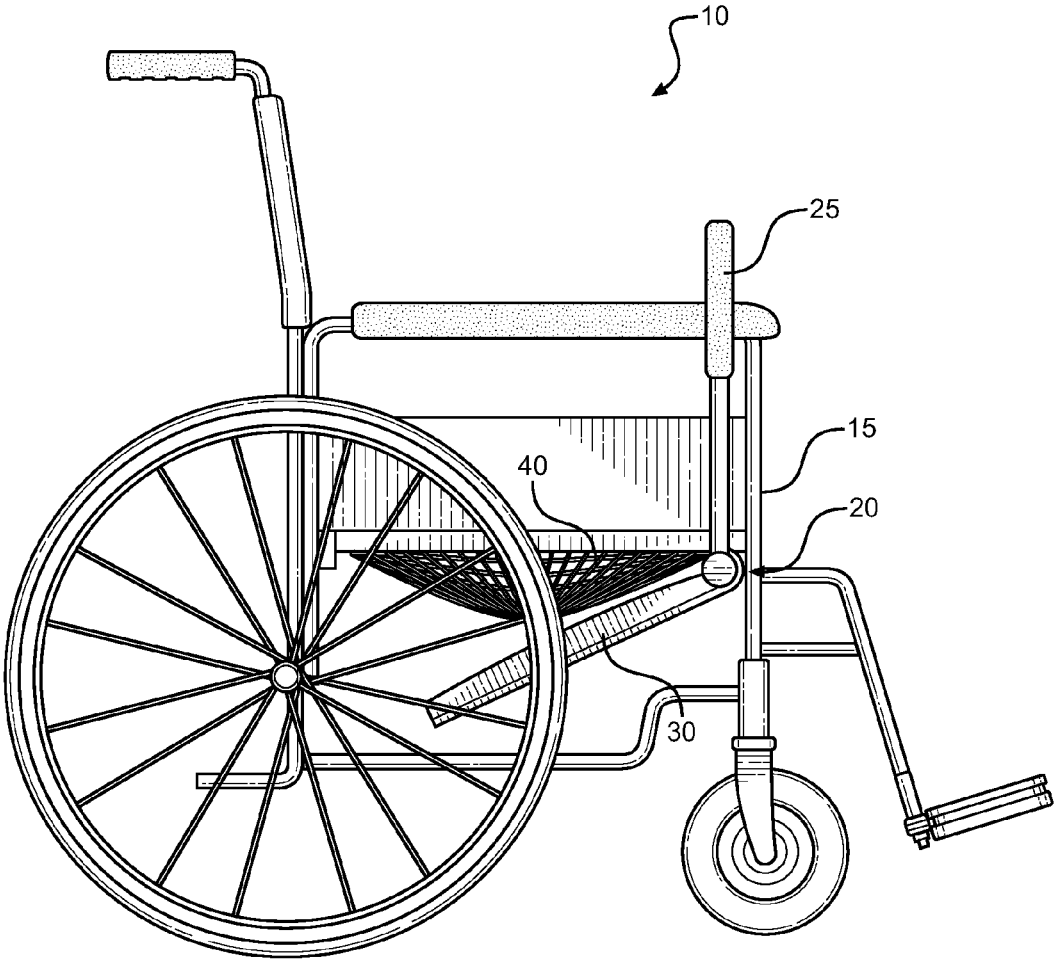
FIG. 1 shows a side view of the adjustable height wheelchair of the present invention, wherein the wheelchair comprises a lever and seat cushion.

Reference is made herein to the attached drawings. Like reference numerals are used throughout the drawings to depict like or similar elements of the adjustable wheelchair of the present invention. For the purposes of presenting a brief and clear description of the present invention, the preferred embodiment will be discussed as used for providing a means for encouraging a posture that reduces the likelihood that a user would fall out of the wheelchair, and further offering an adjustable wheelchair seat including an actuation means. The figures are intended for representative purposes only and should not be considered to be limiting in any respect.

Referring now to FIG. 1, there is shown a side view of the adjustable height wheelchair 10 of the present invention, whereby the wheelchair 10 is provided for facilitating proper posture. The wheelchair positions the posture of the person in an orientation that reduces the likelihood that a user would fall out of the wheelchair. As shown, the wheelchair 10 of the present invention is a manually actuated wheelchair. The device includes a wheelchair frame 15, a lever 20, and a seat cushion 40. The seat cushion 40 and lever 20 are capable of being retrofitted into an existing wheelchair or built into a new one. The lever 20 comprises an upstanding portion 25 and a lower portion 30, whereby the two portions are connected to the wheelchair at a common pivot point. Articulation of the upstanding portion 25 by the user in the forward direction causes the lower portion 30 to press against the seat 40 and assist the user exiting the sunken seat 40.

Figure 2A:
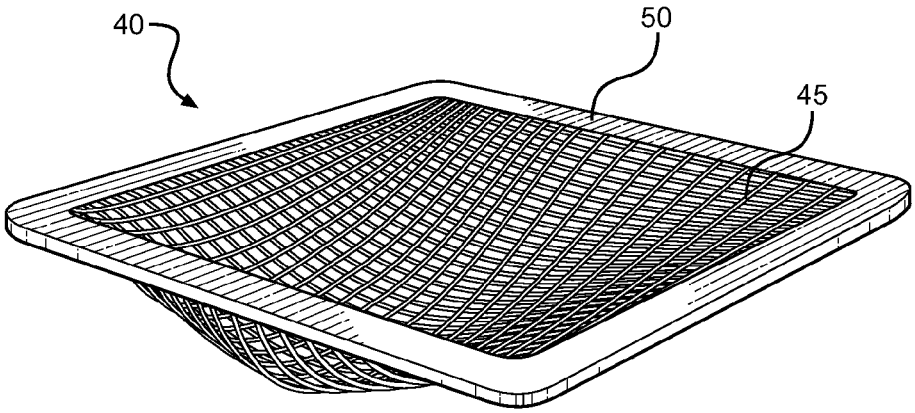
FIG. 2A shows a perspective view of the seat cushion of the adjustable height wheelchair of the present invention.
Figure 2B:
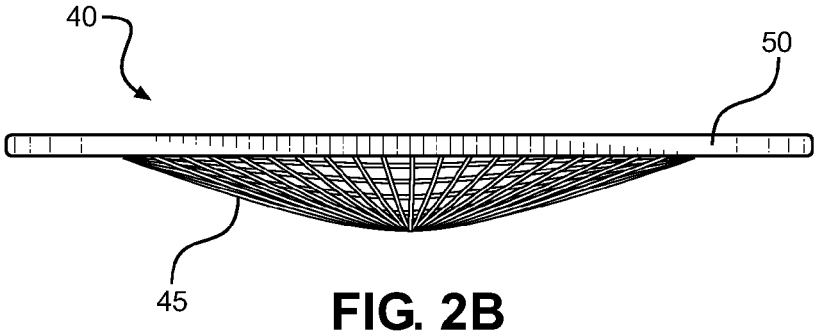
FIG. 2B shows a side view of the seat cushion of the adjustable height wheelchair of the present invention.

Referring to FIGS. 2A and 2B, the seat cushion 40 comprises a frame 50 and an inner surface material 45 that allows for the sinking of the chair section 40 when occupied by a user. The inner surface 45 of the seat cushion 40 encourages a user to assume a posture that reduces the chances that a user would fall off the wheelchair. The inner surface comprises a flexible material and may comprise a mesh material as shown in FIGS. 2A and 2B. The inner surface of the seat 40 comprises a forward portion and rear portion. When a user sits on the mesh 45, the seat rear portion assumes a recessed sitting area that slopes upwards towards the shallow forward portion. The recessed sitting area causes the posterior of the user to sink below the standard wheelchair sitting height, thus bringing the knees to a slightly elevated position. Moreover, the sinking of the mesh 45 of the seat cushion 40 functions to lower the center of gravity of the user, which reduces the likelihood that the user is capable of falling out of the wheelchair. The cushion 40 further functions to facilitate an increase in range and comfort without sacrificing stability within the seat.

Figure 3:
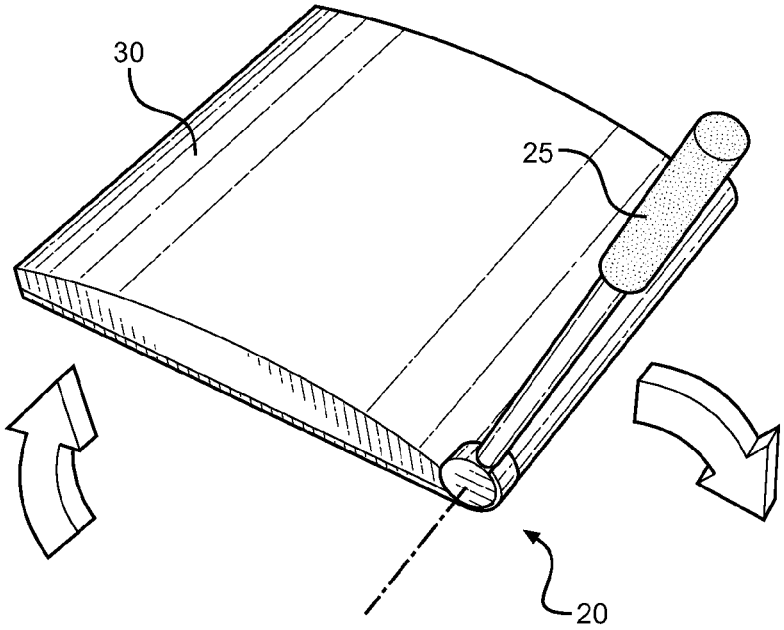
FIG. 3 shows a view of the lever of the adjustable height wheelchair of the present invention.

Referring now to FIG. 3, there is shown a view of the seat lever 20 of the present invention. The lever 20 is configured to raise the seat 40 of the seat cushion 40 from a lower area when occupied by a user, to a height even to that of a standard sitting position along the wheelchair frame 15. Thereafter, the raising of the mesh of seat cushion 40 facilitates a user's exit from the wheelchair 10. The lever 20 comprises an L-shape having a handle 25 and a flat base 30 with a curved upper surface. The base 30 is configured to extend along the underside of the seat cushion 40. The handle 25 extends upward to an area within the reach of the user to facilitate actuation of the device. The lever 20 is pivotally attached at a forward section of the underside of the wheelchair frame 15, whereby the handle 25 section of the lever is located proximally to a user.

Figure 4A:
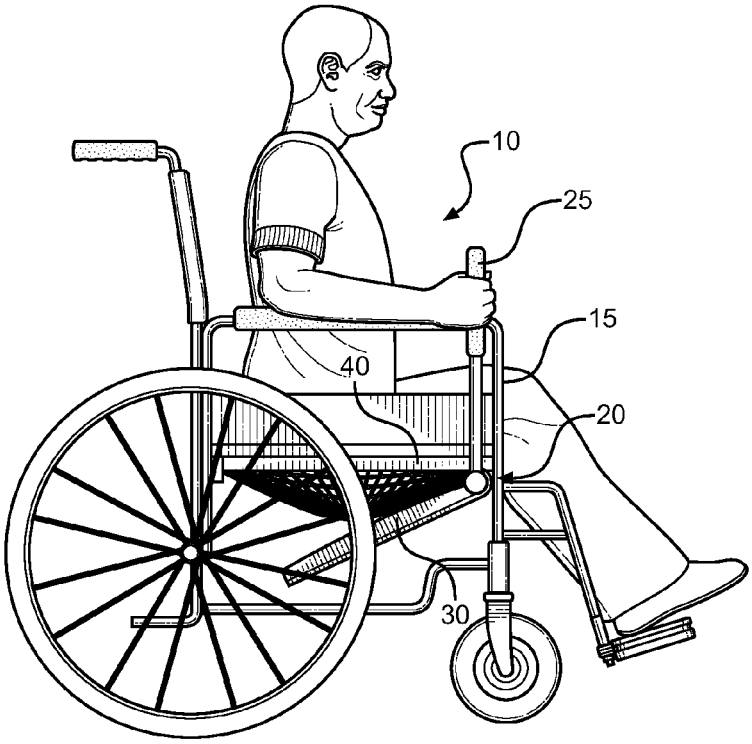
FIGS. 4A and 4B show views of the wheelchair of the present invention in use, wherein the user actuates a lever to facilitate the exiting of the wheelchair.
Figure 4B:
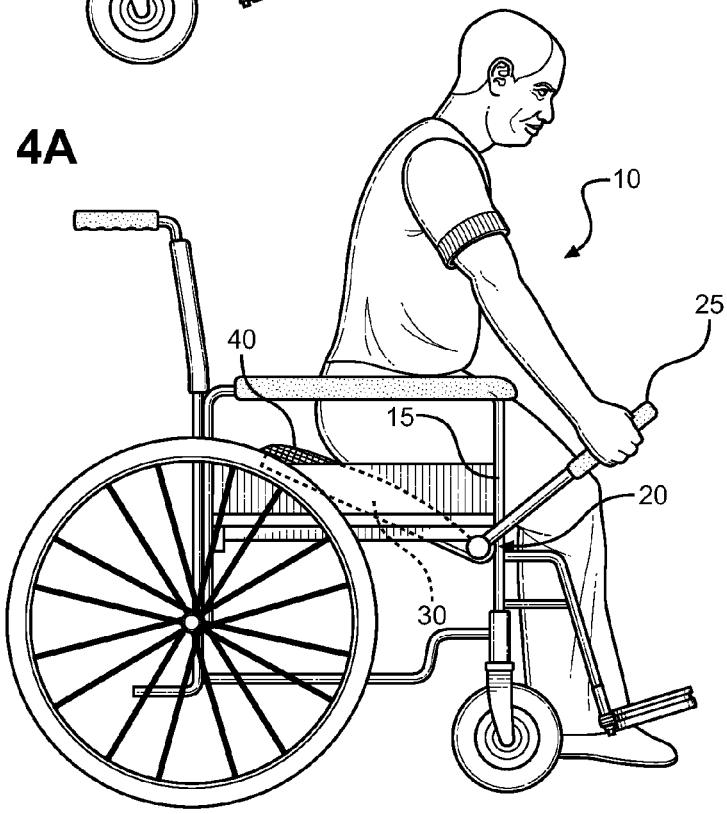

As shown in FIGS. 4A and 4B, in use, a forward actuation about the handle 25 of the lever 20 results in a rotation of the lever 20 about the underside of the frame 15, whereby when the handle 25 is rotated forward, the flat base 30 is rotated upwards and into contact with the mesh cushion 45. Further actuation of the lever 20 facilitates the movement of the mesh cushion 45 upward until it reaches a position at which a user is capable of exiting the wheelchair 10. A forward actuation of the handle 25 is desired because the handle 25 utilizes the natural movements of a person attempting to stand from a sitting position.

When a person sits in the wheelchair 10, the cushion 45 assumes a recessed and angled position that functions to facilitate proper posture of the user and additionally aids in retaining a user in the seat. As a user attempts to exit a wheelchair 10 or any similar sitting instrument, their natural movement is to lean forward prior to standing. The lever 20 of the present invention uses these natural movements of a user attempting to exit a wheelchair 10. The user grabs the handle 25 and actuates the handle 25 forward when attempting to exit the wheelchair 10. The actuation of the lever 20 rotates the handle 25 forward, thus causing the flat base 30 to rotate upward and come into contact with the underside of the mesh cushion 45. The upward movement of the base member 30 and its curved upper surface facilitate the gentle lifting of the user to a level that enables the user to exit the wheelchair 10.

Figure 5:
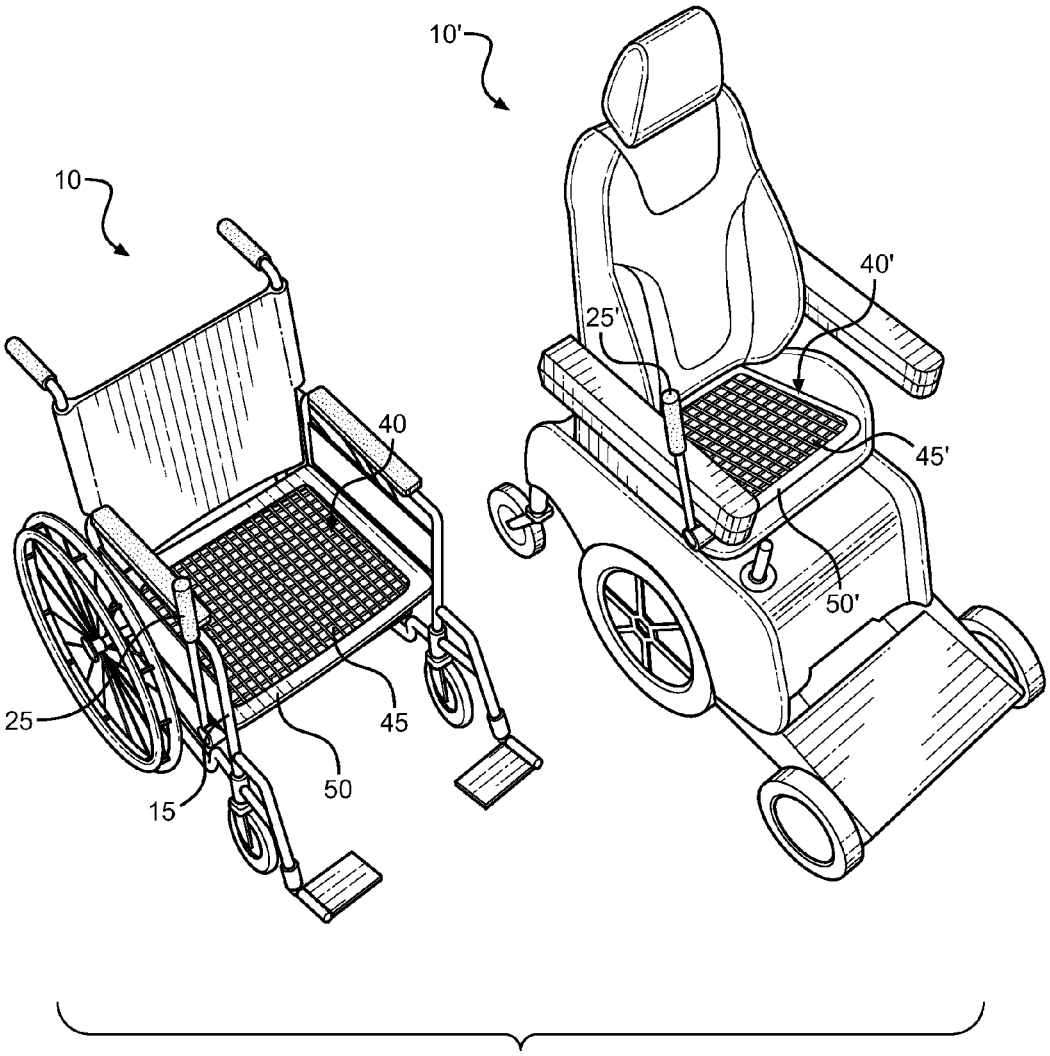
FIG. 5 shows views of the seat cushion of the present invention installed on manually actuated and motorized wheelchairs.

Referring now to FIG. 5, views of the seat cushion 40 of the present invention installed on manually actuated 10 and motorized wheelchairs 10'. The seat cushion 40 and height adjusting lever 20 of the present invention are capable of being installed on manual wheelchairs and motorized wheelchairs. The cushion 40 and lever 20 can be retrofitted onto an existing wheelchair device or installed on a new device. Moreover, the mesh cushion 40 of the present invention can be constructed into alternate orientations which match the seating area of the wheelchair. For example, the seat cushion 40 may comprise a square, rectangular, triangular, parallelogram or a curved shape.

The present invention provides an improved wheelchair device 10 configured to provide a user with enhanced stability and posture. The device 10 comprises either a motorized, or a manually operated wheelchair. The device includes a wheelchair frame 15, a lever 20, and a mesh cushion 40. When the wheelchair device is occupied, the mesh portion 45 of the cushion 40 is configured to sink below the standard wheelchair sitting level. The recessed and angled sitting cushion 40 encourages the user to assume a proper sitting posture. Moreover, the cushion 40 creates a sitting orientation that reduces the likelihood of the user being capable of falling out of the wheelchair. The lever 20 of the wheelchair device 10 is attached to a forward-portion underneath the frame 15, whereby the lever 20 functions to raise the mesh section 45 of the seat 40 of the wheelchair device. The lever 20 comprises a single piece design, and includes a handle portion 25 and a flat base section 30. Forward actuation of the lever 20 results in a forward rotation of the handle 25 and the base 30. The forward rotation of the base 30 causes the upper curved surface of the base 30 to contact the underside of the mesh 45 portion of the seat 40. Continued actuation of the lever handle 25 moves the base 30 against the cushion 45, thus raising the level of the mesh 45 and the user to a height equal to that of a standard wheelchair seat height level along the wheelchair frame 15.

The present invention is designed for those who desire a wheelchair device that provides enhanced stability and reduces the likelihood that a user would fall off the wheelchair. The seat cushion 40 provides a recessed and angled sitting area that facilitates the user's stability. Moreover, the present invention is also designed for those who desire a height adjustable wheelchair device. The height is adjustable by a lever 20 that raises the mesh 45 of the seat 40 level. This design enables a user to exit the wheelchair when leaning forward, thereby actuating the forward movement of the handle 25 and seat 40.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable height wheelchair device, comprising:

a wheelchair frame having a seat area, a first set of rear wheels, and a second set for forward wheels;

a lever pivotally connected to said frame, whereby said lever comprises a lower portion that is directly connected to a base member and an upstanding handle section;

a seat cushion comprising an outer frame and an inner surface, whereby said inner surface is flexible and configured to maintain a sloping, recessed rear portion and a shallow forward portion;

wherein said seat cushion is height adjustable by actuation of said lever, whereby said base member is adapted to bear into said recessed rear portion;

wherein forward actuation of said upstanding handle section affects contact between said seat cushion and said base member to lift said recessed rear portion to a level equal to or beyond horizontal.

* * * * *